US006588105B1

(12) United States Patent
Hoermann et al.

(10) Patent No.: US 6,588,105 B1
(45) Date of Patent: Jul. 8, 2003

(54) METHOD AND DEVICE FOR PRODUCING AN ABSORPTION SILENCER

(75) Inventors: Karl Hoermann, Affing (DE); Georg Vill, Welden (DE); Ruediger Wessling, Gersthofen (DE)

(73) Assignee: Zeuna-Straerker GmbH & Co. KG, Augsburg (DE)

( * ) Notice: Subject to any disclaimer, the term of this patent is extended or adjusted under 35 U.S.C. 154(b) by 0 days.

(21) Appl. No.: 09/787,590

(22) PCT Filed: Dec. 18, 1999

(86) PCT No.: PCT/EP99/10109

§ 371 (c)(1),
(2), (4) Date: Mar. 20, 2001

(87) PCT Pub. No.: WO00/42301

PCT Pub. Date: Jul. 20, 2000

(30) Foreign Application Priority Data

Jan. 14, 1999 (DE) ..... 199 01 150

(51) Int. Cl.[7] ..... B21D 51/16

(52) U.S. Cl. ..... 29/890.08; 29/890.53; 29/429; 29/564.6; 29/33 D; 29/33 Q; 29/781

(58) Field of Search ..... 181/212, 222, 181/256; 219/62, 121.6, 121.63, 121.64; 29/890.08, 428, 429, 430, 431, 557, 564, 564.1, 564.6, 33 D, 33 K, 33 P, 33 Q, 33 S, 33 T, 700, 783, 791, 234, 235, 781, 890.053; 72/49, 51

(56) References Cited

U.S. PATENT DOCUMENTS

| | | | | | |
|---|---|---|---|---|---|
| 1,929,415 | A | * | 10/1933 | Force | 219/62 |
| 4,247,033 | A | * | 1/1981 | Dahmen et al. | 219/62 |
| 5,036,585 | A | * | 8/1991 | Schweinfurth | 29/890.08 |
| 5,190,204 | A | * | 3/1993 | Jack et al. | 219/121.63 |
| 5,479,706 | A | * | 1/1996 | Tamano et al. | 29/890.08 |
| 5,718,045 | A | * | 2/1998 | Tsukahara et al. | 29/890.08 |
| 6,138,791 | A | * | 10/2000 | Zanzie | 181/256 |
| 6,191,382 | B1 | * | 2/2001 | Damikolas | 219/121.62 |
| 6,394,225 | B1 | * | 5/2002 | Yasuda | 181/256 |

FOREIGN PATENT DOCUMENTS

| | | |
|---|---|---|
| DE | 665 167 | 9/1938 |
| DE | 3 805 469 C1 | 9/1988 |
| EP | 0 074 220 A2 | 3/1983 |
| EP | 0 793 989 A1 | 9/1997 |
| FR | 2 166 670 | 8/1973 |
| WO | WO 86/04954 | 8/1986 |

* cited by examiner

*Primary Examiner*—Gregory Vidovich
*Assistant Examiner*—T. Nguyen
(74) *Attorney, Agent, or Firm*—Katten Muchin Zavis Rosenman

(57) ABSTRACT

The invention relates to a method for producing a shock absorber. A section of a steel wool strip is severed from a supply thereof. The perforated area of a tube is wrapped with the steel wool strip section. Said tube is embedded in sound-absorbing material and accommodated in a housing. The steel wool strip section is severed from the supply thereof by a thermal cut. An appropriate device for carrying out the inventive method comprises a supply station for the steel wool strip (6), a severing station (9) for severing individual steel wool strip sections from the steel wool strip supply, a transport station for transporting the steel wool strip and/or the steel wool strip section in the direction (A) towards the tube to be wrapped. Said device also comprises a wrapping station (7) for wrapping the steel wool strip section around the tube, whereby the severing station (9) comprises a thermal severing device (10) for cutting through the steel wool strip (6).

9 Claims, 1 Drawing Sheet

METHOD AND DEVICE FOR PRODUCING AN ABSORPTION SILENCER

FIELD OF THE INVENTION

Figure 1:
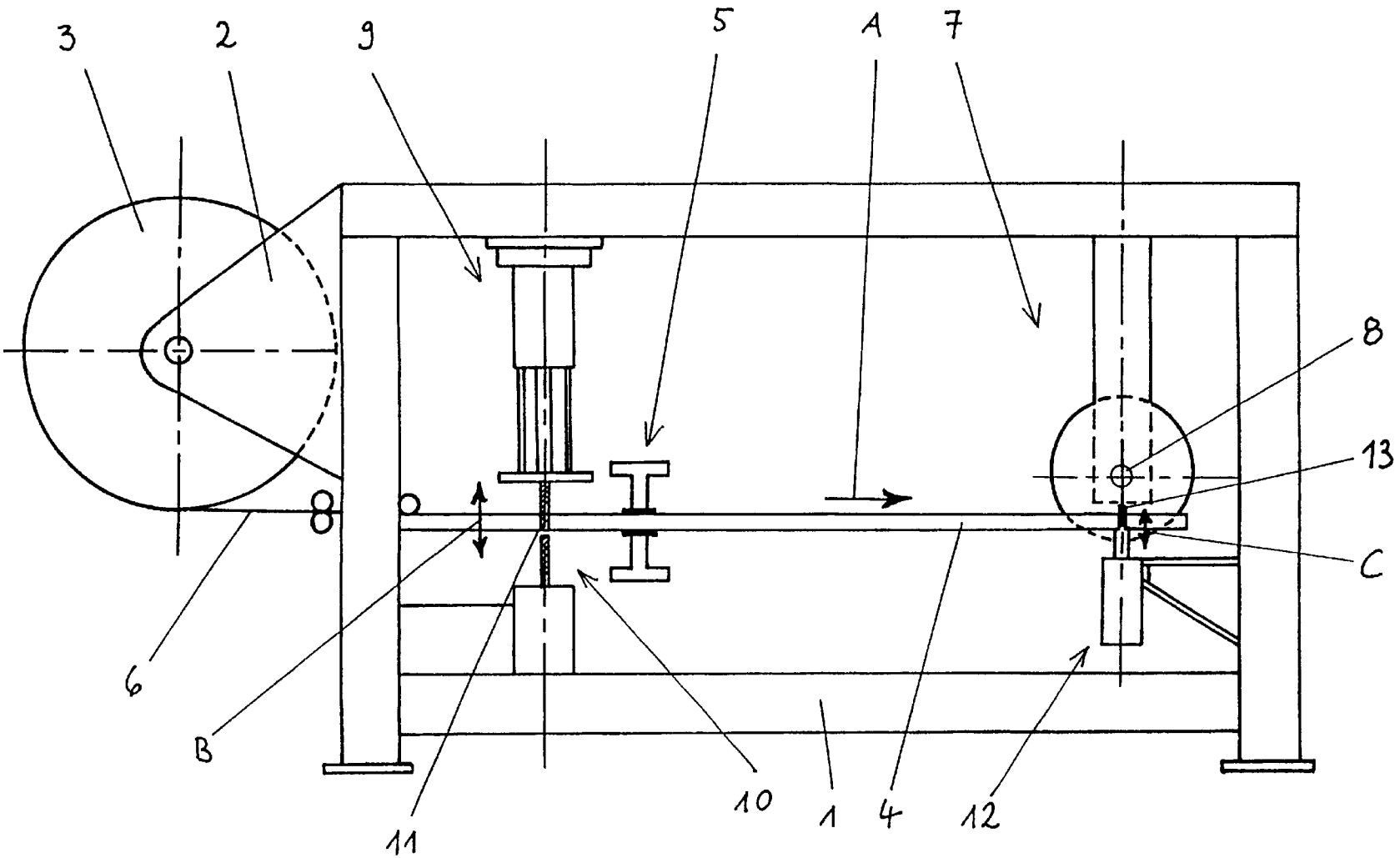

The present invention relates to a method for producing an absorption silencer, in which a section of a steel wool strip is severed from a supply thereof, a perforated tube in the area of its perforation being wrapped with the steel wool strip section, the tube wrapped with the steel wool strip section being embedded in a sound-absorbing material and the tube wrapped with the steel wool strip section and embedded in sound-absorbing material being accommodated in a housing.

BACKGROUND OF THE INVENTION

Absorption silencers comprise at least one absorption chamber filled with sound-absorbing material, an exhaustion pipe being connected to the absorption chamber by way of a perforation. A known problem of absorption silencers is the destruction of the sound-absorbing material by exhaust gas pulsations. In order to protect the sound-absorbing material from being destroyed by pulsating exhaust gas, it is known to cover the exhaust pipe in the region of its perforation with a preformed knitted steel hose or to wrap it with a steel wool strip section. A known process of the type described in the opening paragraph is characterized in that the individual steel wool strip sections are severed from the steel wool strip supply during wrapping onto the respective tube. In order to do this, a device intended to perform the process is equipped with a "brake", which, when activated during wrapping of the steel wool jacket retains the steel wool strip supply, adjoining the contemplated severing point, in such a manner as to cause the steel wool strip to tear. Accordingly, the free end of the steel wool strip section obtained is wrapped onto the tube by continuing the wrapping process.

The known process according to the genus is disadvantageous in more than one respect. In this context a low process reliability is to be emphasized particularly, i.e. high susceptibility to failure. In addition, the relatively high material consumption of steel wool as well as the necessary time requirement for performing the process are deemed disadvantageous.

SUMMARY OF THE INVENTION

From this the object is derived forming a basis of the present invention, which consists in providing a process of the type set out in the opening paragraph, proceeding with relatively low material requirements and shortened time requirement with a high measure of process reliability.

According to the present invention this object is attained in that the severing of the steel wool strip section from the supply is performed by way of a thermal cut. A device suited for carrying out the process is characterized accordingly in that the severing station serving to severe individual steel wool strip sections from the steel wool strip supply comprises a thermal severing device for cutting through the steel wool strip. This measure alone already causes a distinctly increased process reliability of the method cited in the opening paragraph. Because by severing the steel wool strip by means of a thermal cut, the loose ends of the severed steel wool filaments of each of the two steel wool strip sections are welded to one another. The result thereof is that in the region of the end faces of the steel wool strip sections loose ends of the steel wool filaments do not project to a significant degree, which would result in impairing the transport of the steel wool strip or the steel wool strip section respectively. On the contrary, the steel wool strip or, respectively, the steel wool strip sections severed according to the present invention by thermal cuts, can be conveyed without any problem by means of conventional apparatus. Moreover, as opposed to the known generic method, neither dust nor short fragments, which may result in damaging components of the respective device, are formed in the course of severing the steel wool strip sections from the steel wool strip supply. Furthermore, when applying the method according to the invention, the steel wool strip may be designed both wider and thicker (stronger) than is the case in the state of the art. For in the latter case the tensile strength to be applied, which increases with the number of steel wool filaments to be cut, limits both the width of the steel wool strip and its thickness. The possibility provided by the present invention to process a wider and/or thicker steel wool strip results in a plurality of other decisive advantages. Accordingly, in the case, for example, of an appropriately thick steel wool strip, the width of which is grater than the axial length of the perforated region of the tube, the latter needs to be wrapped with the steel wool strip only two to four times in order to ensure adequate protection of the sound-absorbing material. This results in a considerably shortened manufacturing process compared with the state of the art, where, conditional on the use of a thinner and narrower steel wool strip, a several times larger number of wrappings is required. If the steel wool strip used within the scope of the hitherto known process is narrower—as is almost always the case—than the axial extension of the perforated region of the tube, an axial reversing movement of the steel wool strip is required for wrapping the tube. This results in a compacted configuration of the wrapping jacket of steel wool, i.e. the radial dimension of the steel wool jacket is less in its marginal regions than in the center. This results in an unnecessarily high material consumption while the weight of the absorption silencer increases unnecessarily. This applies especially since the steel wool strips of lesser thickness employed up to now can be manufactured only with a relatively large tolerance so that for reasons of reliability some additional wrappings have to be performed. In contrast thereto, when employing the present invention, a steel wool strip of virtually any width and thickness can be processed. An appropriately thick steel wool strip can be produced at a low tolerance so that additional wraps for increased reliability may be dispensed with. The fact that the loose ends of the steel wool filaments in the region of the two end faces of each steel wool strip section are welded to one another, manifests itself by the way not only during the manufacture of the absorption silencer in question. Also in using the absorption silencer this feature proves particularly advantageous. Because in this manner the risk of the steel wool strip section being damaged by the pulsating exhaust gas in the region of its two end faces, is significantly reduced. This results in a greater serviceable life of the absorption silencer in question.

The tube to be wrapped with the steel wool strip section need not, however, have a round cross-section. It may moreover be assembled from a plurality of components and/or comprise added on components. For example, even so-called interior baskets and similar hollow bodies may be considered as "tubes" in the sense of the present invention.

Within the scope of the present invention the steel wool strip section may be severed from the steel wool strip supply before wrapping commences or after wrapping has commenced. The first mentioned pre-commissioning of the steel wool strip sections is in turn favored by the problem-free transport of the sections; it results in a further noticeable time saving in the manufacturing process of absorption silencers.

In a particularly preferred manner severing the steel wool strip section from the supply is performed by resistance fusion. Accordingly, the thermal severing device comprises a particularly preferred resistance fusion beam, connected to a power supply unit.

Another preferred further development of the invention is characterized in that the steel wool strip section is fitted to the tube at the commencement of the wrapping process in the region of its front end—in the conveying direction—by way of at least one spot weld. Accordingly, the device designed for use within the scope of the process according to the invention is advantageously characterized in that at least one spot weld electrode is assigned to the wrapping station. In this context as well it is again of importance that by employing the present invention steel wool strips thicker than those of the state of the art may be processed. For the steel wool strips of lesser thickness processed in the past can virtually not be affixed to the tube by spot welding, since there is a risk that this would result in a fusing away of the correspondingly small number of steel wool filaments.

By means of the at least one spot welding electrode already mentioned, the completely wrapped steel wool strip section may, by the way, be fitted to the tube even towards the end of the wrapping procedure in the region of its rear end—viewed in the conveying direction. This once again represents a saving of time as compared with the state of the art, where for the purpose of a mutual mechanical matting or interlocking of the steel wool filaments an after-running of several revolutions is required, in the course of which a mechanical friction element is pressed against the wrapped steel wool jacket.

The fixation of the steel wool strip section to the tube by way of spot welding is, however, by no means mandatory. Fixation, for example, by mechanical interlocking by means of needles is also possible.

It has already been pointed out that the present invention permits to select a width of the steel wool strip greater than the axial length of the perforated region of the tube so that reversing of the steel wool strip to be wrapped is not necessary. This does, of course, not exclude that under certain conditions such a reversing device might be employed after all. This may, for example, prove advantageous in order to avoid in an individual case, i.e. with a particularly great axial length of the perforated region of the tube the special manufacture of an extra wide steel wool strip and to use in its stead an already available narrower steel wool strip.

Merely for clarity it may be mentioned in addition that in terms of the terminology of the present invention "steel wool strip" not only connotes a strip of intermatted randomly orientated steel filaments. On the contrary, this term also includes such strips made of steel filaments where the latter take up a preset disposition and orientation, for example, in the form of a knitted or woven structure.

In the following the present invention is elucidated in more detail with reference to [the drawing] FIG. 1. The latter shows in a diagrammatic view a device for severing a steel wool strip section from a steel wool strip supply and for wrapping a perforated tube of an absorption silencer in the region of its perforation with the steel wool strip section.

DETAILED DESCRIPTION OF THE INVENTION

The device illustrated in the drawing comprises a frame 1. To this is fitted a holding device 2 for a coiled steel wool strip supply 3. A bed 4 is provided inside the frame 1. A transport unit 5 is assigned to the said bed. The transport unit conveys the steel wool strip 6, unwrapped from the steel wool strip supply 3 on the bed 4 towards (arrow A) the wrapping station 7. The latter in turn comprises a motor-driven rotating receiving device 8 for the tube to be wrapped.

Inside the frame 1 a severing station 9 is furthermore provided comprising a thermal severing device 10 including a resistance fusion beam 11. The resistance fusion beam 11 can be raised and lowered by way of an associated drive means (double arrow B).

Below the wrapping station 7 a welding unit 12 is provided. This comprises two spot welding electrodes 13. These are driven to be vertically displaceable (double arrow C). These permit the fixation to the tube of the beginning and the end of the respective steel wool strip sections.

The wrapping station 7 comprises a reversing device—not illustrated—, which, when needed, causes an axial displacement of the steel wool strip section to be wrapped.

It is apparent from the above description and elucidation of the present invention that the principle used in this application can be applied with the same or corresponding advantages to other technical fields as well, where a problem is to be solved, comparable to the one on which the present invention is based.

What is claimed is:

1. Process for the manufacture of an absorption silencer, comprising the steps of:

severing a section of a steel wool strip from a supply thereof, wrapping a perforated tube in the area of its perforation with the steel wool strip section, and embedding the tube wrapped with the steel wool strip section in a sound-absorbing material and accommodating said embedded tube in a housing, wherein the severing of the steel wool strip section is performed by way of a thermal cut, and wherein the steel wool strip section is affixed to the tube by at least one spot weld at at least one of the beginning of the wrapping process in the region of its front end and towards the end of the wrapping process in the region of its rear end.

2. Process according to claim 1, wherein the severing of the steel wool strip section is performed by resistance fusion.

3. Process according to claim 1, wherein the tube is wrapped with the steel wool strip section two to four times.

4. Process according to claim 1, wherein the width of the steel wool strip is greater than the axial length of the perforated area of the tube.

5. Process according to claim 1, wherein the steel wool strip section is severed from the supply prior to being wrapped onto the tube.

6. Device for severing a steel wool strip section from a steel wool strip supply and for wrapping a perforated tube of an absorption silencer in the region of its perforation with the severed steel wool strip section, comprising:

a supply station for the steel wool strip, a severing station for severing individual steel wool strip sections from the steel wool strip supply, a transport station for conveying the severed steel wool strip section in a direction towards the tube to be wrapped, and a wrapping station for wrapping the tube with the severed steel wool strip section, the wrapped tube being embedded in a sound absorbing material, wherein the severing station further comprises a thermal severing device for cutting through the steel wool strip, and wherein the wrapping station is associated with at least one spot welding electrode for spot welding the severed steel wool strip section to the wrapped tube.

7. Device according to claim 6, wherein the thermal severing device further comprises a resistance fusion beam.

8. Device according to claim 6, wherein the thermal severing device further comprises a resistance fusion beam and wherein the resistance fusion beam and the at least one spot weld electrode are connected to a power supply unit.

9. Device according to claim 6, wherein the wrapping station further comprises a reversing device for axially displacing the steel wool strip section to be wrapped.

* * * * *